US005381630A

United States Patent [19]

Kinner

[11] Patent Number: 5,381,630

[45] Date of Patent: Jan. 17, 1995

[54] BRAKE ROTOR GRINDING METHOD AND APPARATUS

[76] Inventor: James Kinner, 1620 16th Ave., San Francisco, Calif. 94122

[21] Appl. No.: 951,861

[22] Filed: Sep. 28, 1992

[51] Int. Cl.[6] ..... B24B 1/00

[52] U.S. Cl. ..... 451/63 F; 451/258; 451/379; 451/398

[58] Field of Search ..... 51/103 C, 104, 105 R, 51/106 R, 111 R, 118, 117, 217 T, 236, 237, 281 SF

[56] References Cited

U.S. PATENT DOCUMENTS

| | | | |
|---|---|---|---|
| 3,315,419 | 4/1967 | Daubitz | 51/237 R |
| 3,479,775 | 11/1969 | Smith | 51/237 R |
| 3,498,006 | 3/1970 | Lang et al. | 51/237 R |
| 3,618,270 | 11/1971 | Koide | 51/237 R |
| 4,766,702 | 8/1988 | Kinner . | |
| 4,825,596 | 5/1989 | Kinner . | |
| 5,056,266 | 10/1991 | Norris | 51/118 |
| 5,133,155 | 7/1992 | Schwär | 51/118 |
| 5,152,104 | 10/1992 | Wood et al. | 51/118 |

OTHER PUBLICATIONS

SAE Publication SP-914, Section 3.2, "Brakes", pp. 26-32.

*Primary Examiner*—Maurina T. Rachuba
*Attorney, Agent, or Firm*—Thomas M. Freiburger

[57] ABSTRACT

A resurfacing method and apparatus for brake disks or rotors and for flywheels utilizes "dead centers" to support the rotor, flywheel or the like, avoiding disk thickness variations which would result from support of the disk or flywheel on roller bearings. Abrasive grinding wheels are used to effect the resurfacing of the disk, rotating in such a way relative to the disk rotation that a desired, long-wearing surface pattern is produced on the disk or flywheel.

10 Claims, 4 Drawing Sheets

BRAKE ROTOR GRINDING METHOD AND APPARATUS

BACKGROUND OF THE INVENTION

The invention is concerned with resurfacing of brake disks, also known as rotors, and similar rotational articles having precision surfaces, such as clutch flywheels (with precision friction surface only on one side). More particularly, the invention relates to an apparatus and associated method for grinding the surfaces or these precision disks without surface imperfections or high spots which can be caused by "runout" of bearings.

Automotive brake rotors disks are conventionally resurfaced by use of lathe facing methods and apparatus, with the disk supported on ball or roller bearings. Although a relatively high degree of accuracy can be obtained using this conventional resurfacing procedure, there is at least a small degree of "runout" associated with all ball bearings or roller bearings, and this produces slight imperfections in the surfaced disk or rotor. The "runout" is due to a required clearance for movement of and with respect to the balls or rollers in the bearing, and can be further increased by eccentricity of members or wear or imperfection in the shape of the balls, rollers or other parts. The slight eccentricities or variations in the spinning of a disk supported by roller bearings or ball bearings causes undulations or high spots in the surface of the finished disk.

The result of these imperfectly formed disk finishes is a pulsation of the braking torque during application of braking in a vehicle. The driver and passengers feel this as an undulation or pulsed jerking of the vehicle upon brake application, and the driver often further feels this by a pulsation of the brake pedal itself.

The problem of brake torque variation, sometimes called "brake judder", is discussed in the SAE publication SP-914, section 3.2, "Brakes", pages 26–32. In that article it was recognized that disk thickness variations of six ten thousandths of an inch (0.0006″) can cause discernible brake torque variation. However, this article and the industry in general did not recognize the cause of brake torque variation as relating so specifically to thickness variation on the disk or rotor caused by the "runout" of bearing supports during surfacing. The above article does state that if an installed "runout" is present on the disk face, wear during braking is concentrated at the high points, and the article indicates that most manufacturers have installed disk rotor "runouts" better than 0.080 mm. This reference to runout encompasses any eccentricity, play or warp in the rotor, typically 0.002 to 0.003 inch as manufactured, and does not refer to support bearings during surfacing. "Runout" in reference to disks or rotors, as opposed to bearings, refers generally to wobble of the entire disk relative to the shaft journal at the hub. This is different from disk thickness variation, which is more critical in producing undesired torque variation during braking. To some extent the brake pads and calipers can accommodate a certain amount of disk runout, without any brake pulsation or without noticeable brake pulsation. The article also notes that new disk brake rotors do have some initial disk thickness variation from the manufacturing process.

It has been found in accordance with the present invention that disk thickness variations even smaller than six ten thousandths of an inch can cause brake torque variation noticeable to the driver. Generally the thickness variation in a manufactured disk is 0.0006 inch or more, and in any event, the brake torque variation effect tends to increase during the life of the brakes.

Problems with disk thickness variation have been found to be exacerbated with anti-lock brake systems, which have sensors that sometimes tend to read a thickness variation on the disk surface, however slight, falsely as an imminent locking of a brake. This can tend to further increase the pulsation of the automobile and the brake pedal upon application of brakes, particularly heavy application of the brakes.

It is an object of the present invention to achieve near zero disk thickness variation in a surfacing or resurfacing process for brake disks or flywheels.

SUMMARY OF THE INVENTION

In accordance with the invention, brake rotors and flywheels are surfaced by grinding rather than facing, such grinding being disclosed in my prior U.S. Pat. Nos. 4,766,702 and 4,825,596. The disclosures of those patents are incorporated herein by reference. Abrading wheels are positioned on each side of a brake rotor, and are rotated and advanced against the rotor as the rotor spins. A resurfacing pattern may be achieved as shown and described in my earlier patents, or a different pattern may be produced depending on the direction and speed of rotation of the abrading wheel relative to the rotor.

In conjunction with the use of surface grinding rather than facing, a very important feature of this invention avoids any significant high spots in the rotor surfaces produced. This feature involves avoiding use of any conventional bearings to support the rotor in the surfacing operation; neither roller bearings nor conventional oiled bearings are used. Instead, a rotor-supporting assembly is retained for rotation between a pair of "dead centers", i.e. fixed, non-rotational tapered points arranged in opposition to one another. These dead center points engage into complementarily shaped tapered recesses in the ends of a shaft or other members which form the extremities of the rotor-supporting assembly. In this way, the rotating surface contact area is extremely limited while virtually eliminating any possible runout. Oil or grease is placed in the tapered cavities prior to the operation.

The described arrangement has the highly important result that the disk or rotor is prevented from wobble or other eccentricity during grinding where grinding pressure is placed against the surfaces of the spinning rotor, and where grinding pressure may not be equal on both sides of the rotor. The resurfacing operation would pick up any runout of conventional bearings, were they used. Such runout would translate into an eccentricity or wobble effect, producing high spots or disk thickness variation. The system of the invention avoids this critical problem by eliminating runout of the rotor due to the mounting arrangement during surfacing.

The use of dead centers is of course not unknown. Hardened (carbide) dead centers have been used with case hardened mandrels in lathe operations previously. However, it was not previously recognized that the critical problem of disk thickness variation could be virtually eliminated through use of dead centers to support a brake rotor during a grinding surfacing operation.

It is therefore among the objects of the invention to achieve near-zero brake disk thickness variation, producing a surface which is truly parallel to within one ten thousandth of an inch (disk thickness variation), by supporting the brake disk during abrasive grinding in such a way as to allow a true rotation. These and other objects, advantages and features of the invention will be apparent from the following description of preferred embodiments, considered along with the accompanying drawings.

DESCRIPTION OF PREFERRED EMBODIMENTS

Figure 1:
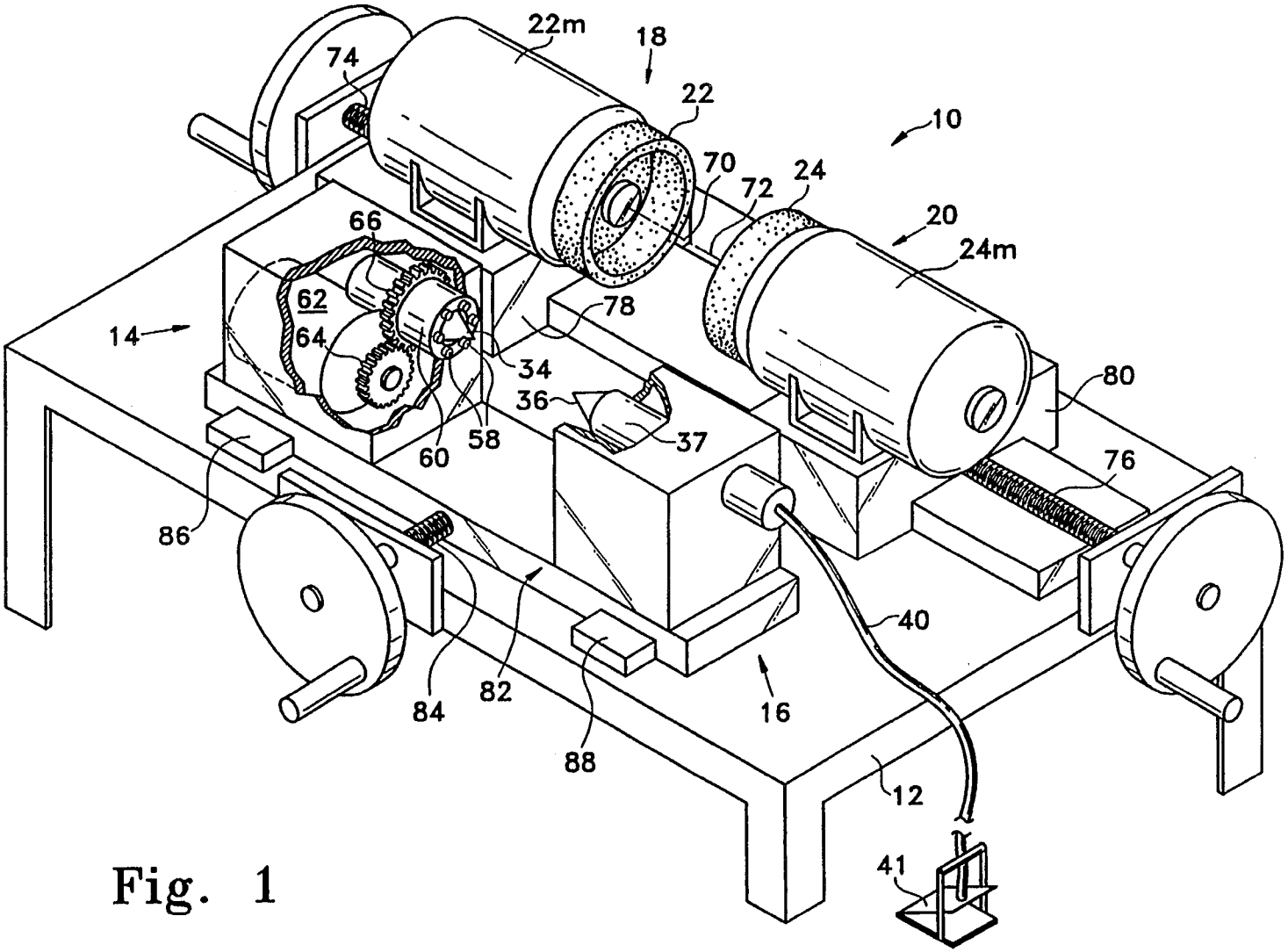
FIG. 1 is a perspective view showing a system and apparatus in accordance with the invention for surfacing of brake disks or flywheels.

In the drawings, FIG. 1 shows in perspective a brake or rotor surfacing assembly 10 which includes a table 12, a left support and drive assembly 14, a right support assembly 16, a left grinder assembly 18 and a right grinder assembly 20. Surfacing or finishing of disks or flywheels is accomplished by two opposed abrading wheels 22 and 24 of the grinding assemblies. These act on the surfaces of a rotating disk 27 (FIG. 2) retained on an arbor assembly 25 supported between the left and right support assemblies 14 and 16.

As shown in all of the drawings, the arbor assembly 25 has an adaptor 26 to which a disk or flywheel 27 is secured and retained. The adaptor 26 is a very precisely formed component which has surfaces true enough, i.e. perpendicular to the axis of rotation, that disk runout due to this mounting is nearly eliminated. Disk runout of less than one ten thousandth of an inch can be achieved for relatively heavy disks such as automotive brake disks, and within about three or four ten thousandths for thinner, more flexible disks such as used on motorcycles. As noted above, disk runout is less critical than disk thickness variation.

Figure 2:
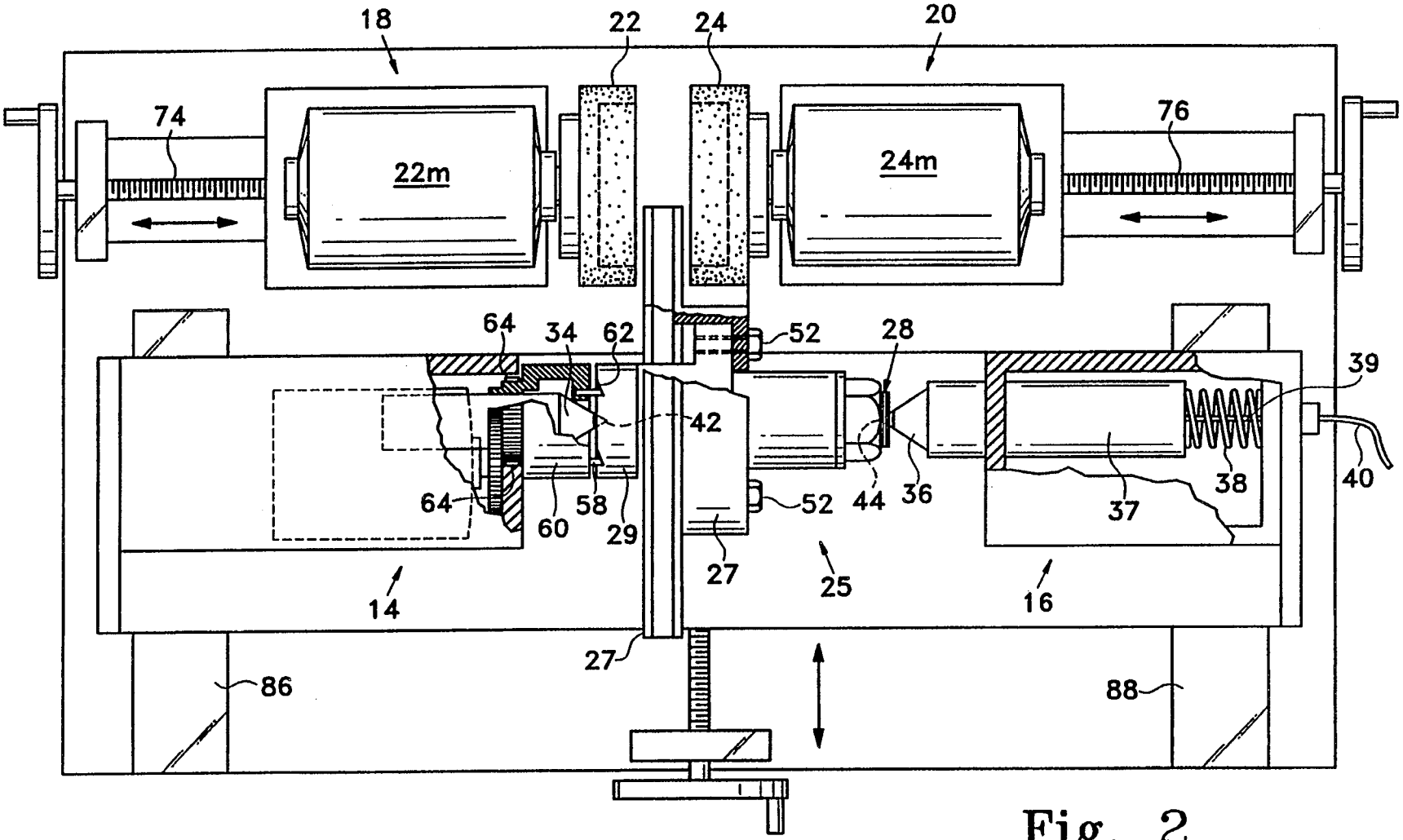
FIG. 2 is a plan view showing the system of FIG. 1, with an arbor and mounted disk, for two-sided resurfacing of the disk.
Figure 3:
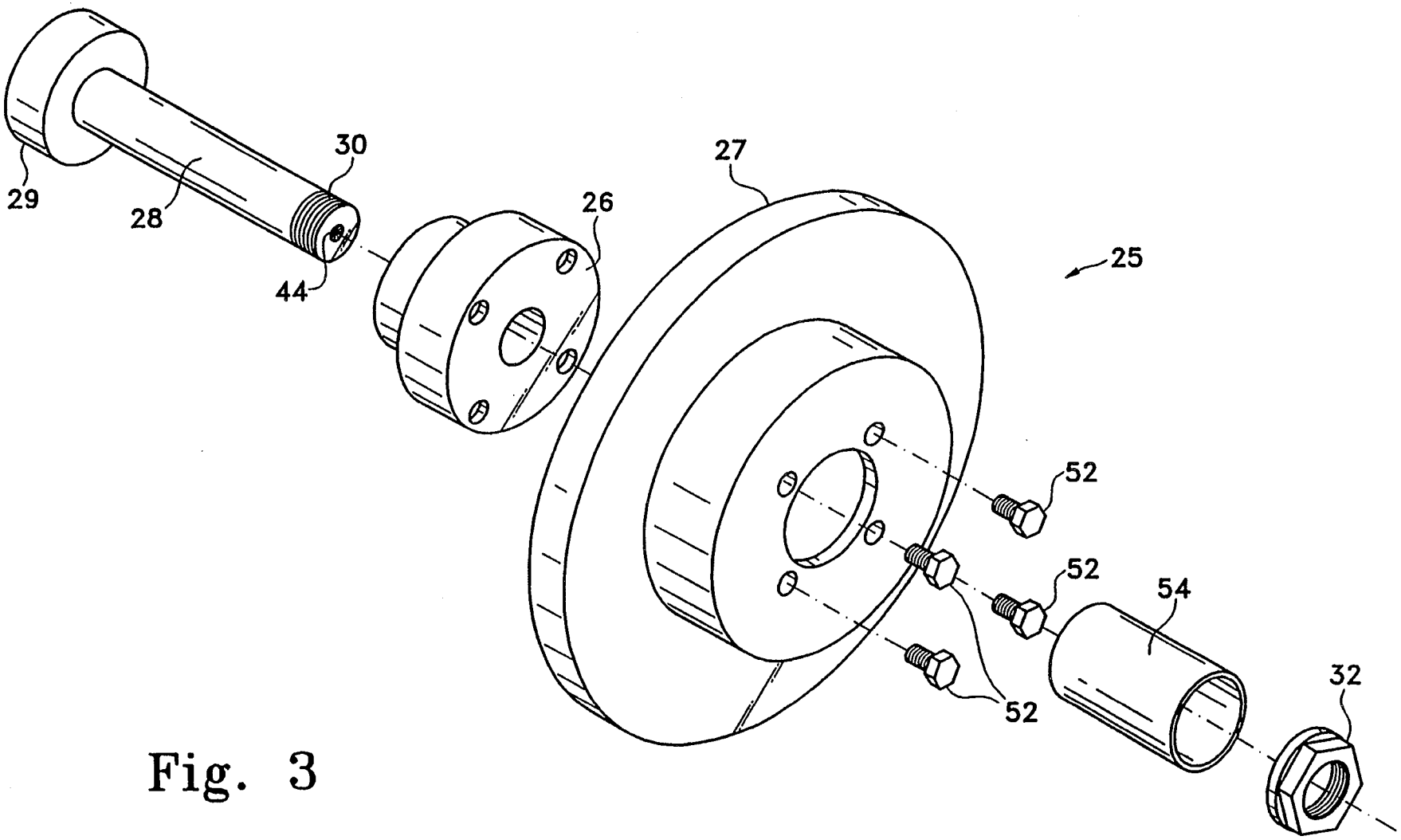
FIG. 3 is an exploded perspective view showing parts of the rotational arbor or mandrel, which supports the disk or flywheel, also shown, in the support arrangement of the invention.

The arbor adaptor 26, as shown in FIGS. 2 and 3, receives an arbor 28 having an arbor head 29 at its left end. Its opposite end has threads 30 to receive a nut 32. The arbor assembly 25 is described further below.

As explained above, an important feature of the invention is that the disk supporting arbor is rotationally supported not by conventional bearings, but by dead centers. Left and right dead centers 34 and 36 are shown in the drawings. These are fixedly mounted and non-rotational relative to the table 12. One of the dead centers, in this case the dead center 36, is axially retractable in order to adjust the dead center support for opening to accommodate placement of the arbor or to adjust the engagement of the dead centers with the arbor. As one arrangement which can be used, FIG. 2 shows the retractable dead center 36 as part of a shaft which has a sliding fit within a rigidly fixed bore in a support 37, with the dead center biased by a heavy compression spring 38. FIGS. 1 and 2 show that the dead center 36 may be retractable by a cable 39 passing through a sheath 40, operable conveniently by a schematically shown foot pedal 41.

The two dead centers preferably each comprise a carbide tip brazed onto high speed steel forming the remainder of the cone and the shaft which extends slidably into the support 37.

The arbor 28 has at each end, axially located a concave conical recess 42, 44 complementarily shaped to the tapered, pointed dead centers 34, 36. The conical recess 44 is seen in FIG. 3; the recess 42 is not seen but is found in the end of the arbor head 29.

The arbor assembly 25 is formed of several components as indicated in the exploded view of FIG. 3. These include the arbor 28, the disk-engaging adaptor 26, cap screws 52 for securing a disk 27 to the adaptor as indicated, a compression sleeve 54 and the nut 32 which may have a locking feature or preferably is set up so that the rotation tends to tighten the nut. This assembly including the disk 27 acts as a secure, rigid unit for supporting between the dead centers 34, 36. The arbor with the rotor is positioned between the two dead centers, with appropriate lubricant applied, and the one retractable dead center 36 is returned toward the other, into position to engage the arbor for runout-free rotation.

As shown in FIG. 3, the rotor adaptor 26 of the arbor assembly is slid onto the arbor 28, in a very close fit. The brake rotor or disk 27 is then secured to the adaptor 26 with the four cap screws 52. The spacer sleeve 54 is slid over the arbor 28, and the arbor nut 32 is secured on snugly to complete the assembly. The arbor 28 as well as the adaptor 26 are both trued as an assembly (without the rotor) while turning between dead centers 34. 36 by the abrading wheel 24, to establish a near zero runout condition. Disk runout of less than 0.0005 inch and thickness variation of less than 0.0001 are achieved by using tooling as described.

As both FIGS. 1 and 2 illustrate, rotational driving of the arbor assembly 25 carrying the mounted disk 27 is a series of driving pins 58 which are fixed to a cylindrical spindle 60 rotatable around the exterior of the fixed left dead center 34. The rotatable spindle 60 may be gear-driven as shown, via a motor 62 and gears 64, 66. In engaging the arbor head 29 at the left side of the arbor assembly 25, as shown particularly in FIG. 2, the driving pins 58 enter tapered recesses 62 of the arbor head, so that the rotational motion and support of the arbor is completely unaffected by the driving engagement with the pins, driving engagement being only in the positive rotational direction. Thus, any run-out or play in bearings 64 supporting the cylindrical spindle 60 will not affect the essentially run-out free rotational support the arbor assembly 25 with the disk 27 it supports.

FIGS. 1 and 2 illustrate the left and right grinding assemblies 18 and 20. As noted above, each includes a grinding or abrading wheel 22, 24 rotatable on axes 70, 72, each of which may be slightly tilted relative to the axis of rotation of the arbor 25. As explained in the above referenced U.S. Pat. Nos. 4,766,702 and 4,825,596, the grinding resurfacing of the rotor or disk using this small tilt, and with a prescribed range of relationship between the rotation of the grinding wheels and the rotation of the disk, creates a spiral type finish pattern on the disk. The system of the invention, however, is effective to produce near-zero disk thickness variation regardless of the type of pattern which is produced on the disk surfaces. Thus, as an alternative, the abrading wheels 22 and 24 and their respective driving motors 22*m* and 24*m* can be set up so that all axes of rotation are parallel which will produce a cross-hatched pattern on the disk surface.

The grinding wheels 22 and 24 are advanced against the face of the disk, with this adjustment schematically indicated as being via a pair of screw advancement shafts 74 and 76 moving motor carriages 78 and 80 (although it preferably is via a load sensing arrangement wherein motor current changes indicate changes in abrading pressure against the disk, as described in U.S. Pat. No. 4,825,596 incorporated herein by reference). The two grinding wheels preferably rotate in the same direction, preferably opposite to the direction of rotation of the disk 27, as described in my above-referenced earlier patents. As noted above, these relative velocities can be varied in order to produce different finish patterns.

Lateral position adjustment of the disk 27 relative to the abrading wheels 22 and 24 preferably is accomplished by movement of the arbor assembly on a carriage 82, shown as adjustable by a screw shaft 84 and supporting the dead centers 34, 36. The arbor carriage 82 with the arbor assembly 25 is translatable on the table 12 with very close tolerances, via slide guides 86 and 88, so as not to allow off-angle shifting of the carriage 82. The position of the carriage and arbor assembly remain static during use, following final adjustment to place the disk surfaces at the proper location. If desired, the carriage could thus be locked in position on the table while the surfacing operation proceeds; however, this has not been found necessary.

During operation, the abrading wheels 22, 24 remain directly opposed to one another on either side of the rotor. Grinding pressure on both sides of the rotor is kept approximately balanced, reducing the effects of any very slight possible runout in the dead center mounting. The grinding wheels are advanced into engagement with the rotor surfaces as successive finishing passes are taken with the rotor and this may be controlled as described in my earlier patent referenced above.

Figure 4:
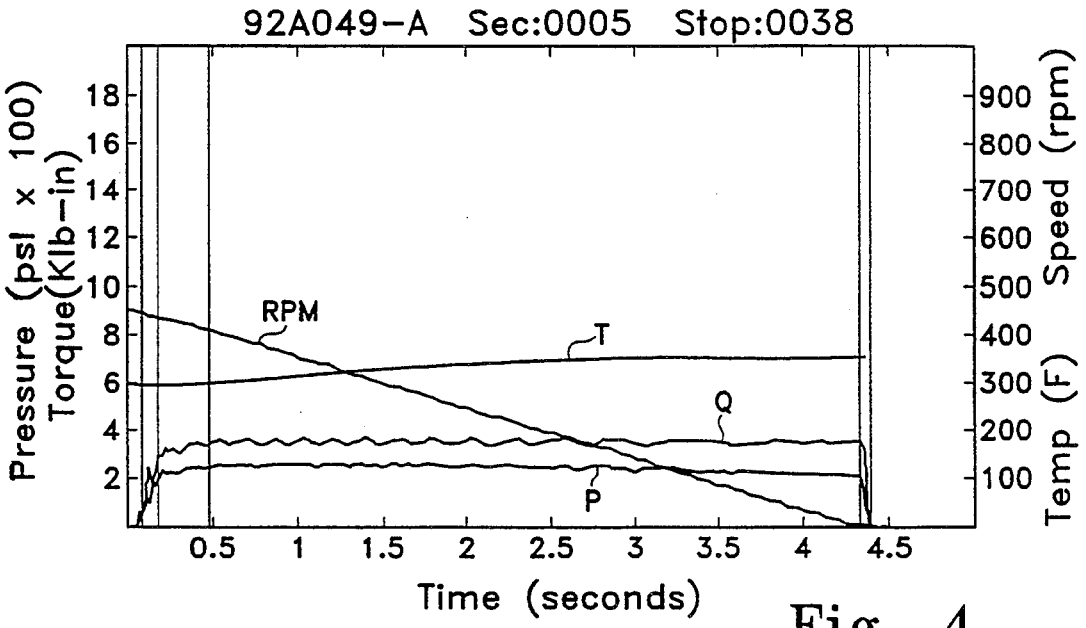
FIG. 4 is a graph representing a braking test using a stock, OEM-supplied disk brake rotor. The graph shows temperature, speed (rpm), brake pressure and torque versus time.
Figure 5:
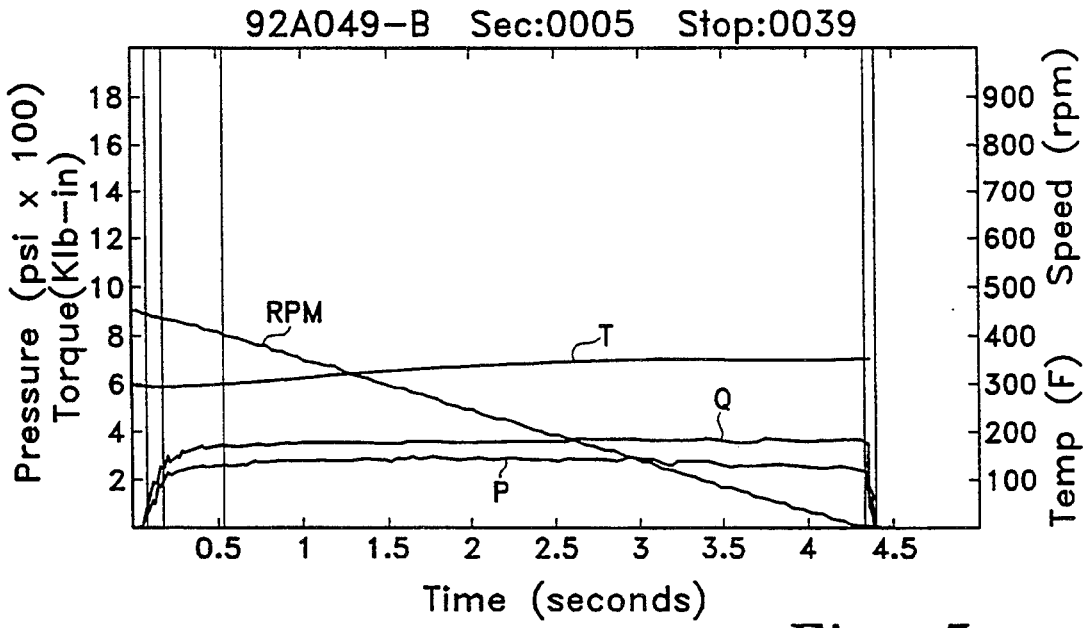
FIG. 5 is a graph similar to FIG. 4, showing the same test conducted with a brake rotor resurfaced in accordance with the invention.

FIGS. 4 and 5 are a pair of companion graphs representing two successive tests of brake disks under identical circumstances and conditions. FIG. 4 shows the results of a test using a new stock rotor or brake disk as supplied as OEM equipment by an American automobile manufacturer. The disk was measured and found to have disk thickness variation of 0.0005 inch, which is about as parallel as is available in DEM rotors. FIG. 5 shows the same test performed on a similar rotor which had been resurfaced in accordance with the present invention. The graphs show hydraulic braking pressure P, braking torque Q, rotational speed RPM and temperature T, each plotted against time. A comparison of the two curves Q for braking torque shows a distinct undulation in braking torque in FIG. 4, as experienced with the new, stock OEM brake rotor, with the period of the undulations becoming longer as rotor RPM decreases.

However, with the rotor which had been resurfaced in accordance with the invention, FIG. 5, the braking torque curve Q displays virtually no undulation, most of the small irregularities in the curve being a result of the recording equipment.

The above described preferred embodiments are intended to illustrate the principles of the invention but without limiting its scope. Other embodiments and variations to these preferred embodiments will be apparent to those skilled in the art and may be made without departing from the essence and scope of the invention as defined in the claims.

I claim:

1. A method for producing a finished surface on a brake disk or flywheel, comprising the steps of:

mounting the disk or flywheel securely and fixedly on an arbor, mounting the arbor for rotation between a pair of tapered dead centers, the arbor having end means for rotational engagement with the two dead centers, including applying appropriate lubricant between the arbor end means and the dead centers and engaging the arbor between the two dead. centers, so that the arbor can be rotated between the dead centers with substantially no runout, rotating the arbor with the disk or flywheel, and advancing against at least one surface of the disk or flywheel, a motor driven abrading wheel capable of grinding the surface of the disk or flywheel, whereby the dead center mounting of the arbor supports the rotation of the disk or flywheel without use of conventional bearings, and high spots or disk thickness variation is nearly eliminated.

2. The method of claim 1, wherein the disk or flywheel is a disk having two surfaces, and the method comprising resurfacing simultaneously both surfaces of the disk with a pair of opposed motor driven abrading wheels on either side of the disk.

3. The method of claim 2, wherein the two abrading wheels are applied against the opposed surfaces of the disk with substantially equal pressure.

4. The method of claim 1, including rotating the abrading wheel on an axis which is slightly tilted relative to the axis of rotation of the arbor and the disk or flywheel, thereby producing a spiral type finish pattern on the disk surface.

5. The method of claim 1, including driving the arbor by a pin engagement means extending from a driving spindle coaxial with one of the dead centers, the pin engagement means not being connected to the arbor except by a forward driving engagement.

6. Apparatus for producing a finished surface on a brake disk or flywheel having at least one substantially flat working surface, comprising:

an arbor, and a mounting means for mounting the disk or flywheel securely and fixedly on the arbor, a pair of aligned, tapered dead centers, the arbor having end means for rotational engagement against the two dead centers and being engaged between the two dead centers so that the arbor can be rotated between the dead centers with substantially no runout, with appropriate lubricant applied between the dead centers and the end means of the arbor, motor means for rotating the arbor with the disk or flywheel, and means for advancing against at least one said working surface of the disk or flywheel, a motor driven abrading wheel capable of grinding said working surface of the disk or flywheel, whereby the dead center mounting of the arbor eliminates any conventional bearings supporting the rotation of the disk or flywheel, and high spots or disk thickness variation is nearly eliminated.

7. The apparatus of claim 6, wherein the disk or flywheel is a disk having two surfaces, and including a pair of opposed said motor driven abrading wheels on either side of the disk or flywheel, for resurfacing both surfaces simultaneously.

8. The apparatus of claim 7, including means for applying the two abrading wheels against the opposed surfaces of the disk with substantially equal pressure.

9. The apparatus of claim 6, wherein the abrading wheel has an axis of rotation which is slightly tilted relative to the axis of rotation of the arbor and the disk or flywheel, thereby producing a spiral type finish pattern on the disk surface.

10. The apparatus of claim 6, including drive means for driving the arbor, including a driving spindle coaxial with one of the dead centers, with pin engagement means extending from the driving spindle and not connected to the arbor except by a forward driving engagement.

* * * * *